United States Patent [19]

Hamlin

[11] Patent Number: 5,016,833

[45] Date of Patent: May 21, 1991

[54] DOCUMENT ROLL-UP SYSTEM

[75] Inventor: Thomas J. Hamlin, Macedon, N.Y.

[73] Assignee: Xerox Corporation, Stamford, Conn.

[21] Appl. No.: 494,385

[22] Filed: Mar. 16, 1990

[51] Int. Cl.[5] ..... B65H 18/16

[52] U.S. Cl. ..... 242/66; 242/67.2; 242/DIG. 3; 53/118

[58] Field of Search ..... 242/66, 65, 67.2, DIG. 3, 242/67.1 R; 53/118, 430

[56] References Cited

U.S. PATENT DOCUMENTS

| | | | |
|---|---|---|---|
| 2,551,866 | 5/1951 | Bevins et al. | 242/55 |
| 3,498,559 | 3/1970 | Sames | 242/67.2 |
| 4,080,711 | 3/1978 | Kawada et al. | 53/118 X |
| 4,115,913 | 9/1978 | Moriya et al. | 53/118 X |
| 4,494,706 | 1/1985 | Becherer et al. | 242/65 |
| 4,784,345 | 11/1988 | Romanowski et al. | 242/66 |
| 4,830,304 | 5/1989 | Fuke et al. | 242/67.2 |
| 4,838,497 | 6/1989 | Kramer et al. | 242/67.2 |

*Primary Examiner*—John M. Jillions

[57] ABSTRACT

A roll-up apparatus is provided for automatically rolling up a plurality of media sheets such as copy sheets from a document copier. In one embodiment a pair of semicircular guide members and a removable plastic C shaped ring are aligned perpendicular to the media sheet feed motion. The first and succeeding sheets are scrolled up within the circular interior space formed by the guide members and the C ring. The guides are designed to retract after the roll-up operation leaving the rolled up copies to be restrained by the C ring. The C ring and rolled up sheets can then be conveniently moved to a desired location.

3 Claims, 4 Drawing Sheets

DOCUMENT ROLL-UP SYSTEM

BACKGROUND AND INFORMATION DISCLOSURE STATEMENT

The present invention relates to a device for automatically rolling up media sheets and, more particularly, to an apparatus incorporated into a document reproduction machine which automatically rolls up output sheets into a tubular form within a removable roll-up device.

There are in the prior art, copying applications wherein copies reproduced from an original document are required to be scrolled into a spiral configuration for convenient handling and storage. Typical of such applications are the reproduction of wide format documents such as engineering drawings and the like. The Xerox 2510 copier is one example of such prior art reproduction machine.

The 2510 copier operator inserts a copy sheet into a registration position and then introduces an original to be copied into a continuous velocity transport device. The original document, as it emerges from the exposure zone, must be manually retrieved. The output copy may either be retrieved manually, or allowed to fall onto a support table or the like. The output copy may also be automatically rolled up for subsequent removal by a mechanism of the type disclosed in U.S. Pat. No. 4,784,345 assigned to the same assignee as the present invention. The roll-up device disclosed in that patent incorporates a roll-up assembly comprising a curved baffle arrangement with drive rollers positioned along the circumference. The output copy is moved along a spiral path on the interior surface of the roll-up assembly. Upon completion of the roll-up, and taping operation, the assembly is pivotally opened and the rolled-up, taped, output copy removed.

An alternate roll-up device is disclosed in copending U.S. application Ser. No. 07/155,445, filed on Feb. 12, 1988 now U.S. Pat. No. 4,838,497. This application discloses an output copy roll-up station wherein a plurality of flexible, circular guide members are aligned perpendicular to the path of the copy sheet movement. The copy sheets are scrolled up within a circular interior space formed by the guide members. The guides are designed to expand radially outward along their width to accommodate the increasing area of successively rolled-up output sheets. Other examples of roll-up assemblies designed to roll-up output sheets are disclosed in U.S. Pat. No. 2,551,866 (Bevins et al) and U.S. Pat. No. 3,498,559 (Sames).

With the prior art arrangements described above, it is necessary for an operator to manually remove each copy or copies from the copy roll-up assembly, and either file or store the copies or make some further disposition. In the assembly disclosed in the Sames patent, the operator must remove and replace the same roll-up assembly. These operations and functions reduce throughput since the time taken to handle the output copies subtracts from the time the operator can be feeding originals into the exposure station. It would, therefore, be desirable to have a copy output station capable of automatically rolling up one or more original copies, during a copy operation and providing a means for removing the rolled-up copies without any adverse impact on throughput time. Such a copy station is realized in the present invention by providing a roll-up "C" ring which is movably mounted at the output station. The ring can permit scrolling up of a plurality of outputs sheets within a central area. When the particular copy operation is terminated, the ring is easily detached and replaced immediately by a second ring. While the next copy operation proceeds, the operator is then free to further remove the document from the ring, store the ring, etc., or simply allow a plurality of rolled-up documents to accumulate until all can be conveniently removed. The present invention is, more particularly, directed to an apparatus for rolling one or more media sheets into a tubular configuration, the apparatus including, means for accepting said media sheets from a media output station and for feeding said sheets into a roll-up assembly, the roll-up assembly including; at least one semicircular retractable guide member forming an interior roll-up space; a "C" ring centered along the same axis as said guide member in a roll-up location, roller means for scrolling said sheet within the circular space formed by said "C" ring and retractable guide member, and means for retracting said guide member so as to disengage contact with said sheet whereby said sheet is maintained in a rolled-up configuration within said "C" ring, said "C" ring becoming detached and free to be moved to another location.

BRIEF DESCRIPTION OF THE DRAWINGS

Referring to FIG. 1 of the drawings, there is shown a xerographic type reproduction machine 8 incorporating the document roll-up system 10 of the present invention. Machine 8 has a suitable frame 12 on which the machine xerographic components are operatively supported. Briefly, and as will be familiar to those skilled in the art, the machine xerographic components include a recording member, shown here in the form of a rotatable drum 14 having a photoconductive surface. Other photoreceptor types such as a belt or web may instead be contemplated. Operatively disposed about the periphery of photoreceptor 14 is a charge corotron 18 for placing a uniform charge on the photoconductive surface of photoreceptor 14, an exposure station 20 where the previously charged photoconductive surface is exposed to image rays of the document 9 being copied or reproduced, development station 24 where the latent electrostatic image created on the photoconductive surface is developed by toner, transfer station 28 with corotrons 29, 30 for transferring the developed image to a suitable copy substrate material such as a copy sheet 32 brought forward in timed relation with the developed image on photoconductive surface, cleaning station 34 and discharge corotron 36 for removing leftover developer from the photoconductive surface and neutralizing residual charges thereon.

Figure 1:
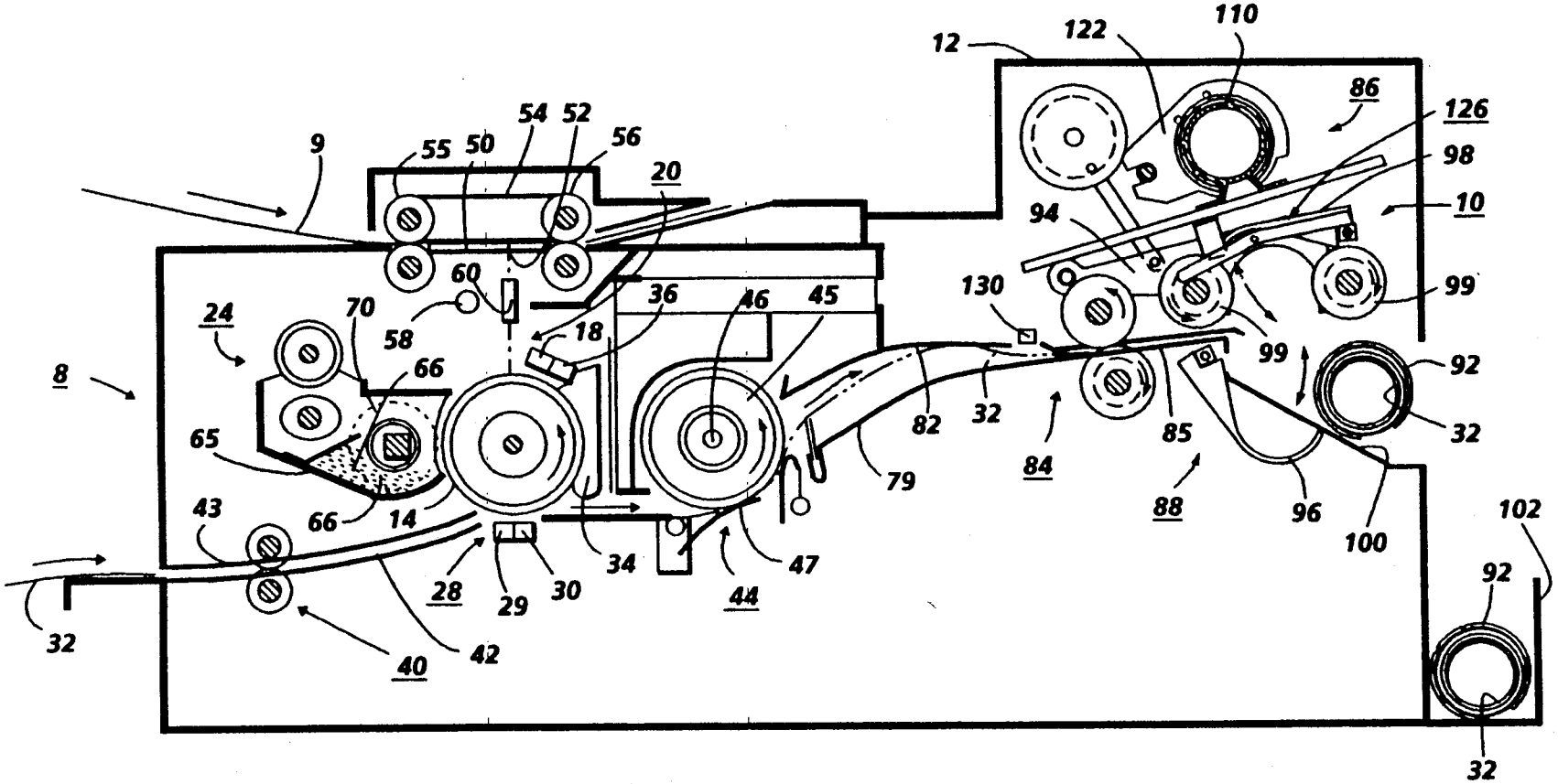
FIG. 1 is a side view of the document roll-up system of the present invention.

Copy sheets 32 are brought forward to transfer station 28 by feed roll pair 40 and sheet guides 42, 43. Following transfer, the sheet 28 is carried forward to a fusing station 44 where the toner image is fixed by fusing roll 45. Fusing roll 45 is heated by a suitable heater such as lamp 46 disposed within the interior of roll 45. After fixing, the copy sheet 32 advances to feed roller pair 84 and then enters the document roll-up system 10 whose operation is described in detail below.

Continuing with the description of machine 8, transparent platen 50 supports the document 9 as the document is moved past a scan point 52 by a constant velocity type transport 54. As will be understood, scan point 52 is, in effect, a scan line extending across the width of platen 50 at a desired point where the document is scanned line by line. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 20 to expose the photoconductive surface of the moving photoreceptor 14.

Developing station 24 includes a developer housing 65, the lower part of which forms a sump 66 for holding a quantity of developer. As will be understood by those skilled in the art, the developer comprises a mixture of larger carrrier particles and smaller toner or ink particles. A rotatable magnetic brush developer roll 70 is disposed in predetermined operative relation to the photonconductive surface. In developer housing 65, roll 70 serving to bring developer from sump 66 into developing relation with photoreceptor 14 to develop the latent electrostatic images formed on the photoconductive surface thereof.

Figure 2:
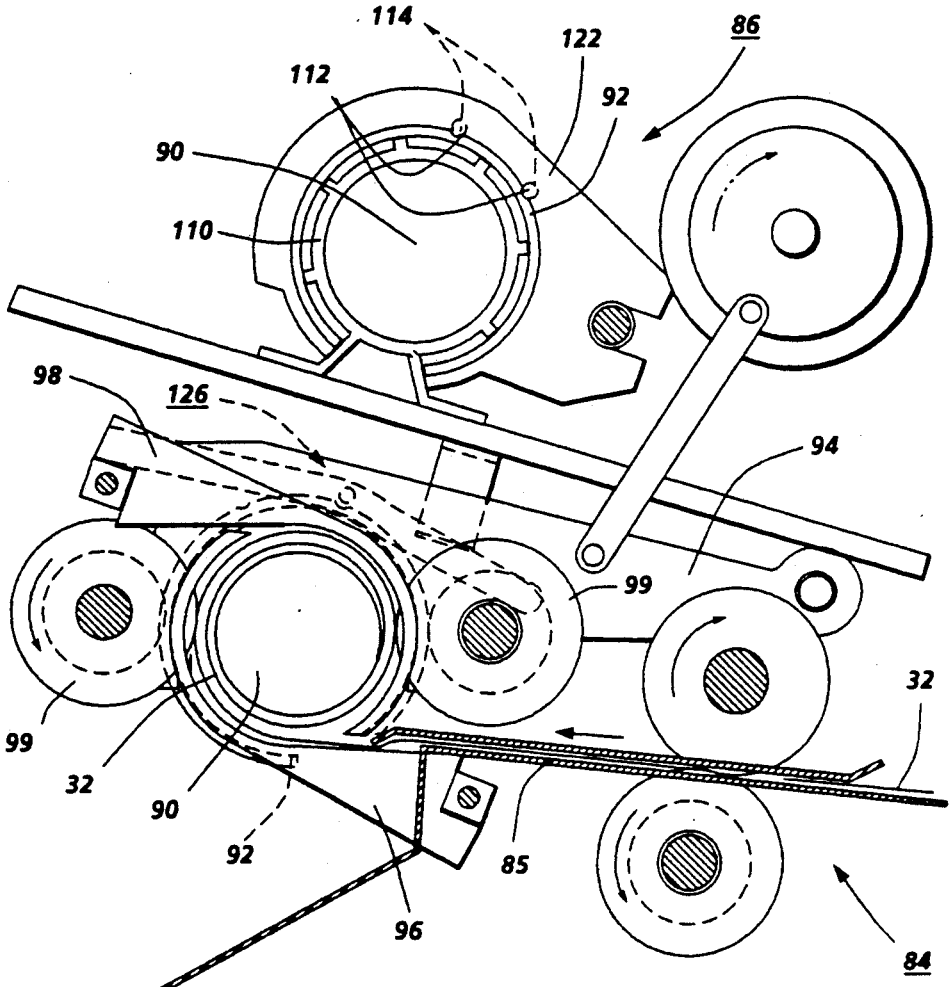
FIG. 2 is a rear side perspective view of the roll-up system of FIG. 1.
Figure 3:
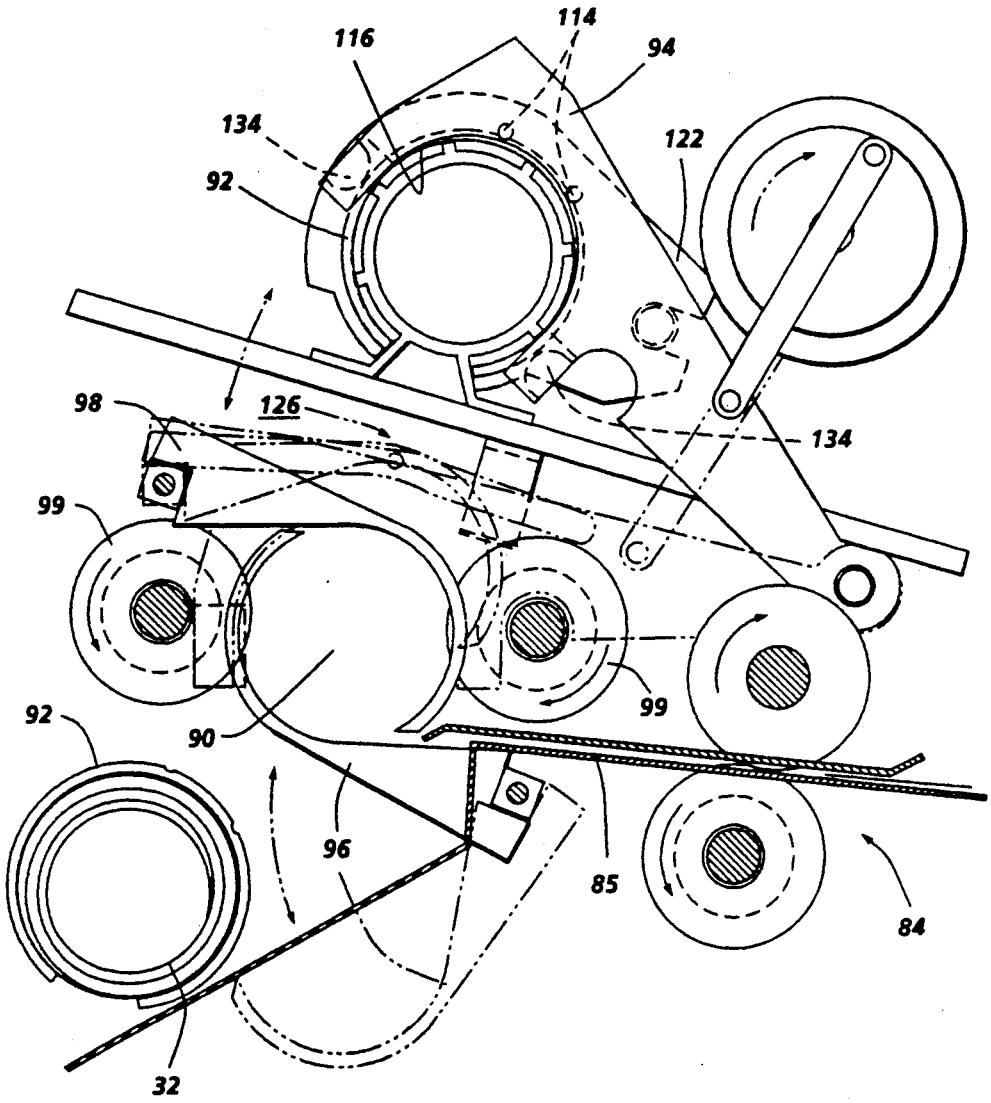
FIG. 3 is a second rear side perspective view of the roll-up system showing the release of a rolled-up document.
Figure 4:
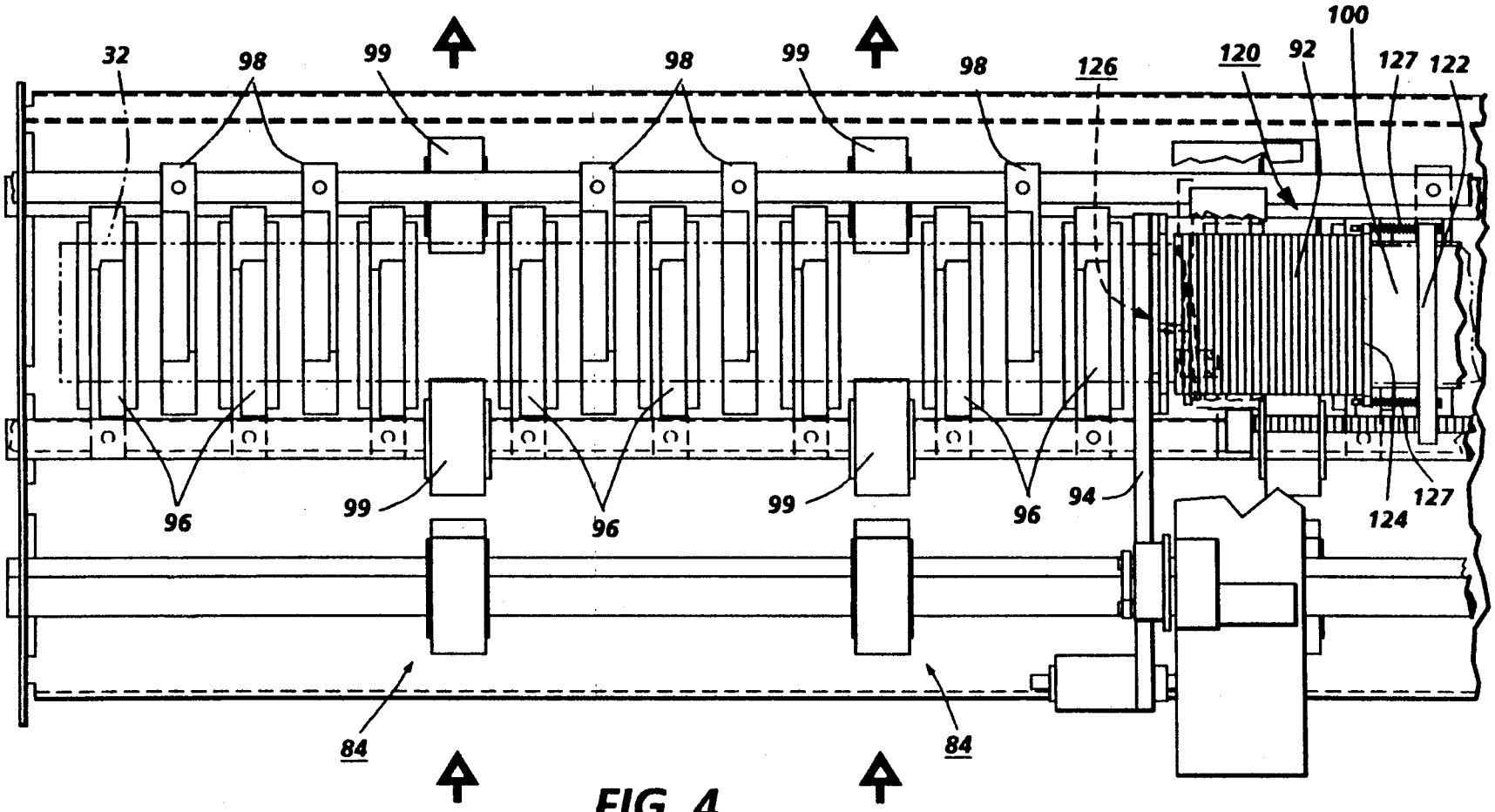
FIG. 4 is a partial top view of the roll-up system of FIG. 1.

Turning now to the document roll-up system 10 shown generally in FIG. 1 and in more detail in FIGS. 2–4, the system can be considered as having a first upper area 86 characterized as a C-ring retention and loading mechanism, and lower area 88 which can be characterized as a copy sheet scrolling and release area. A brief overview of operation will be followed by a more detailed description of both areas with reference to FIGS. 2–5.

Figure 5:
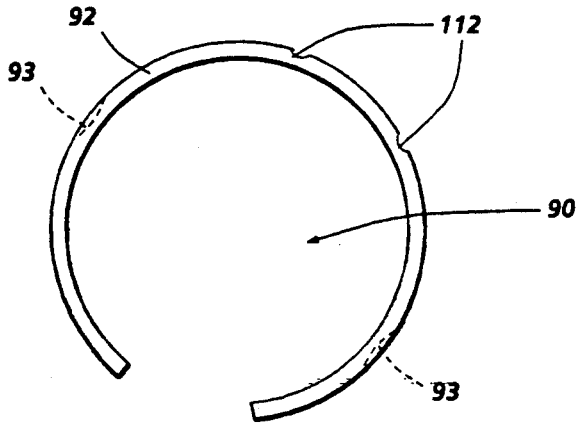
FIG. 5 is a side view of the C-ring which maintains the copy sheets in a rolled-up configuration.

As shown in FIGS. 1 and 2, copy sheets 32 are advanced by roller pair 84 along inclined baffle plate 85 into a roll-up space which is generally defined as the space between roll-up baffle members 96, 98, and a C-ring 92. Ring 92, shown in FIG. 5, is moved from a retention position (FIG. 4) into the roll-up loaded position shown in FIG. 2 by action of a pivotable arm member 94. Referring to FIG. 2, ring 92, compressed slightly to reduce its diameter, is held firmly in a copy sheet load position by arm 94 so that copy sheet 32 advances in the direction of the arrow entering the C-ring interior space 90 through the opening in the "C". The copy sheet is generally guided into a roll-up configuration by a plurality of curved pivoting baffle fingers 96, 98. A copy sheet, scrolls up within the C-ring and is constrained within the smaller diameter of the rolled-up area 90. Foam rollers 99 assist the roll-up operation along the length of the rolled-up sheets. Upon completion of the roll-up operation, fingers 96, 98 pivot to the open position shown in FIGS. 1 and 3. Arm 94 is pivoted upward releasing C-ring 92 by cam action. The ring "springs" out to its normal configuration, and the rolled-up copy sheets expand radially outward to be firmly held within the ring. The rolled-up copy sheet held within ring 92 then is free to roll down baffle member 100 into a copy bin 102 to either be simply retrieved or allowed to remain until copy operations are complete.

The above was an overview of the operation of roll-up system 10. A more detailed description of the operation taking place within areas 86 and 88 now follows.

Referring first to FIG. 4, rings 92 are adapted to be moved sequentially from the left end of loading member 110 downward into a position shown in FIG. 2 where the open space 90 of ring 92 is aligned with the travel path of copy sheet 32. Each ring has a pair of notches 112 (FIG. 5) which are adapted to be aligned by pins 114 extending along the inner surface of feed mechanism 120. Arm 94 has attached to a side surface an opposed pair of pads 134 (FIG. 2) between which ring 92 is captured (at points 93, FIG. 5) and held in a slightly compressed orientation. Arm 94 and, therefore, the left most C-ring 92 is located generally central to the path of copy sheets which are advancing in the direction of the arrow shown in FIG. 2. The rings are periodically moved from right-to-left in FIG. 4 by a feed mechanism 120 which includes a first cross bar 122, mounted on threaded shafts. A pair of spring members 127 are connected between first cross bar 122 and a second cross bar 124. Upon initiation of a copy roll-up operation, bar 94 having an engaged C-ring 92 already contained within jaw 116 is pivoted downward (from FIG. 3 position) to place the ring in a rolled-up position in FIG. 2. The ring 92 then awaits the arrival of the next sheet 32 which is advancing along the paper path (baffle plate 81) into the opening of C-ring. the sheet then scrolls within ring 92 still held within jaw 116 of arm member 92. a sensor 130 detects the trailing edge of copy sheet 32 and sends a delayed signal to accomplish the following functions. First, as the trail edge of sheet 32 enters area 90 of C-ring 92, baffle member 96, 98 pivot outwards to the position shown in FIGS. 1 and 3. Arm member 94 is pivoted upwards. A slightly cammed surface on arm 94 encounters cam assembly 126 causing arm 94 to flex inward releasing C-ring 92 from the secured position between pads 134. C-ring 92, freed from the crimping pressure, resumes its normal orientation; copy sheet 32 held within area 90, expands outward slightly still maintaining a snuggly rolled configuration within area 90. The rolled-up copy sheet with C-ring now falls by gravity into output bin 102 as shown in FIG. 1.

Continuing with the sequence of activations following detection of the trail edge of sheet 32, arm 94 continues to pivot upwards to its furthermost upward position which places jaw 116 just above the height of the stored C-rings 92. Arm member 94 pivots downward simultaneously with activation of mechanism 120. Mechanism 120, driven by a reversible motor (not shown) advances from right-to-left. Bias bar 124 is spring driven by springs 127 against the outermost ring 92, thus, advancing the innermost ring 92 along pins 114 into the locating position defined by pads 134. Mechanism 120 is then returned to its home position and arm 94 is in position to deliver the next C-ring into the rolled-up position upon receiving the next document roll-up signal.

It is thus apparent that a convenient method and apparatus are provided for rolling up and transporting output sheets in a simple and inexpensive manner.

While the invention has been described with reference to the structure disclosed, it is not confined to the details set forth, but is intended to cover such modifications or changes as may come within the scope of the invention.

What is claimed is:

1. Apparatus for rolling one or more media sheets into a tubular configuration, the apparatus including, at least a pair of opposed semicircular baffle members aligned along the central axis and defining a generally circular roll-up space therebetween, means for locating a C-ring along the same central axis as said baffle members, means for feeding said media sheets into the interior of the C-ring causing the media to roll-up within said C-ring interior, means for releasing said C-ring from said locating means upon completion of the roll-up operation, and means for pivoting said baffle members so as to release the C-ring with the rolled-up media therebetween, the C ring and media being then free to move by gravity into a holding location.

2. The apparatus of claim 1 including a plurality of C-rings held in a storage area proximate the roll-up area, said holding means adapted to move a ring said storage area into said central axis location.

3. The apparatus for rolling one or more media sheets into a tubular configuration, the apparatus including:

a plurality of generally curved opposed, retractable baffle members arranged along a central axis coincident with a media transport path, said baffle member, in a closed position, defining a generally circular interior roll-up space, means for conveying a C-ring from a first storage location to a second location coincident with the same central axis as said baffle members, and means for feeding said media sheets into the interior space of said C-ring in a scrolling operation.

* * * * *